US005086602A

United States Patent [19]

Pukas

[11] Patent Number: 5,086,602

[45] Date of Patent: Feb. 11, 1992

[54] INSULATION CLIP

[75] Inventor: Paul Pukas, Salmon Arm, Canada

[73] Assignee: Tech-Crete Processors Ltd., Salmon Arm, Canada

[21] Appl. No.: 675,827

[22] Filed: Mar. 27, 1991

[51] Int. Cl.[5] ..... E04F 13/00

[52] U.S. Cl. ..... 52/713; 52/489; 52/593; 52/763; 52/509

[58] Field of Search ..... 52/763, 593, 509, 713, 52/506

[56] References Cited

U.S. PATENT DOCUMENTS

| | | | |
|---|---|---|---|
| 2,200,649 | 5/1940 | Wardle | 52/DIG. 6 |
| 2,281,519 | 4/1942 | Faber | 52/489 |
| 2,338,870 | 1/1944 | Praeger | 52/361 |
| 4,052,831 | 10/1977 | Roberts | 52/509 |
| 4,348,847 | 9/1982 | Jukes | 52/713 |
| 4,571,911 | 2/1986 | Dunlap | 52/509 |
| 4,627,777 | 12/1986 | Johansson | 52/713 |

*Primary Examiner*—John E. Murtagh
*Attorney, Agent, or Firm*—Jeffrey T. Imai; Arne I. Fors

[57] ABSTRACT

A clip is disclosed for retaining an insulation panel or the like to a planar surface. The insulation panel has opposite edges provided with a tongue and groove formation for matingly interlocking with adjacent like panels. The clip comprises a piece of sheet material having a base adapted to lie flush on the planar surface upon which the insulation panel is to be mounted. The base is adapted to be secured to the planar surface. The clip has an interlock portion adapted to follow the contours of the joint between adjacent tongue and groove interlocks. The interlock portion terminates within the thickness of the insulation panel. The interlocking member has a slot extending substantially perpendicular to said base portion for receiving a fin member. The fin member engages the interlocking member and projects outwardly from the interlock member for engaging a cut in each of the opposite edge surfaces of the insulation panel whereby the fin member restricts relative sliding movement between the clip and the insulation panel when said clip retains said insulation panel to the wall surface.

6 Claims, 3 Drawing Sheets

INSULATION CLIP

FIELD OF INVENTION

This invention relates to a clip for attaching and retaining a pre-finished insulation panel to a wall or a structure surface.

BACKGROUND OF INVENTION

In modern construction, concrete and various concrete products are used in foundations and walls of buildings and other structures. While concrete has a relatively high thermal conductivity, it may be desirous to increase the R value or insulation value of the wall or structure. Plain or pre-finished insulation panels of various R values may be applied to the surface of the wall or structure.

In constructing wood framed buildings, an outer plywood or particle board panel is nailed to the wood frame to present a wall surface. Insulation panels are applied to the outside surface of the wall structure to increase the R value of the wall structure prior to applying a brick veneer siding, aluminum siding or other finishing surface.

Pre-finished insulation panels generally are configured to have a length which is twice the width. The common size is a 2'×4' insulation panel. The pre-finished insulation panels have a "tongue and groove" interlock on the longitudinal edge surfaces of the panel. One of the longitudinal edge surfaces will have a tongue formation extending along the surface and an opposite edge surface will have a recess or groove complimentary to the tongue formation. The tongue formation of one panel is inserted into the recess of a superior or adjacent panel when affixed to the wall surface to provide an insulation layer without gaps between rows of or adjacent panels.

The pre-finished insulation panels may have a broomed or striated pattern finish in natural colour or a paint ready grade. These pre-finished insulation panels may be applied directly to the wall surface and need not be covered with additional facade surfaces.

Glue has been used to affix the insulation panels to the wall surface. However, glued panels must be substantially destroyed in order to repair or replace the insulation panel or the wall panel or to obtain access behind the wall surface, adding to future repair costs.

Nails, screws or staples also have been used to affix the insulation panel to the wall surface. However, the nail or the like must pass through the insulation panel and into the wall. A direct path is provided for heat to be transferred from the inside of the building to the outside or vice-versa through the nail thereby reducing the R or insulation value of the insulation.

Clips have been proposed which are nailed or otherwise affixed to the wall surface. The clips have an interlock portion which conforms to the tongue and groove formation of the insulation panel. The clip is affixed to the wall surface and the interlock portion extends into the junction between panels to retain it to the wall. The interlock portion extends only partially through the thickness of the junction between the insulation panel eliminating any direct path for heat transfer. The overall or insulation value of the panel is thereby maintained. Such insulation clips have been disclosed in U.S. Pat. Nos. 2,317,428, 2,831,222 or 4,299,069.

The prior art clips work satisfactorily to retain an insulation panel to a wall. When such a clip is installed on a lower edge surface, the bracket will act to both retain the panel to the wall surface and support the panel. Additional clips are required on the top edge surface and the side edge surfaces to retain the insulation panel to the wall surface. These clips are satisfactory if a clip can be installed on a lower edge surface of the panel. If a regular clip would be unsightly on the lower edge surface, special bottom clips have been proposed in order to adequately support the insulation panels. However, by having more than one type of clip, installation of the insulation panels can become more costly and inconvenient if the installer were to run out of one type of clip.

It is sometimes desirable architecturally to install the pre-finished insulation panels in a vertical orientation. The vertical orientation of the insulation panel is useful when installing insulation at or near the foundation where the fastening devices are held above the grade and above the waterproofing membrane. The prior art clips are not suitable for vertically mounting the pre-finished panels.

The disadvantages of the prior art may be overcome by providing an insulation clip having a detachable a fin which can retain and support an insulation panel regardless of the orientation of the insulation panel.

In particular, the disadvantages may be overcome by providing a clip with a fin which prevents sliding movement of the insulation panel relative to the insulation clip when the clip is installed.

It is a further object of this invention to provide a clip which when installed is concealed from sight and the elements of the weather permitting the pre-finished insulation panels to be installed either horizontally or vertically.

According to one aspect of the invention there is provided a clip for retaining an insulation panel or the like to a planar surface. The insulation panel has opposite edges provided with a tongue and groove formation for matingly interlocking with adjacent like panels. The clip comprises a piece of sheet material having a base adapted to lie flush on the planar surface upon which the insulation panel is to be mounted. The base is adapted to be secured to the planar surface. The clip has an interlock portion adapted to follow the contours of the joint between adjacent tongue and groove interlocks, one portion of which being in position to overlie within the joint interface and another portion of which being a position to underlie within the joint interface the groove. The interlock portion terminates within the thickness of the insulation panel to avoid visibility of the material of the fastener in the joint between the adjacent mounted insulation panels. The interlocking member has a slot extending substantially perpendicular to said base portion for receiving a fin member. The fin member engages the interlocking member and projects outwardly from the interlock member for engaging a cut in each of the opposite edge surfaces of the insulation panel whereby the fin member restricts relative sliding movement between the clip and the insulation panel when said clip retains said insulation panel to the wall surface.

BRIEF DESCRIPTION OF DRAWINGS

In drawings which illustrate embodiments of the invention.

DETAILED DESCRIPTION OF THE PREFERRED EMBODIMENT

Figure 1:
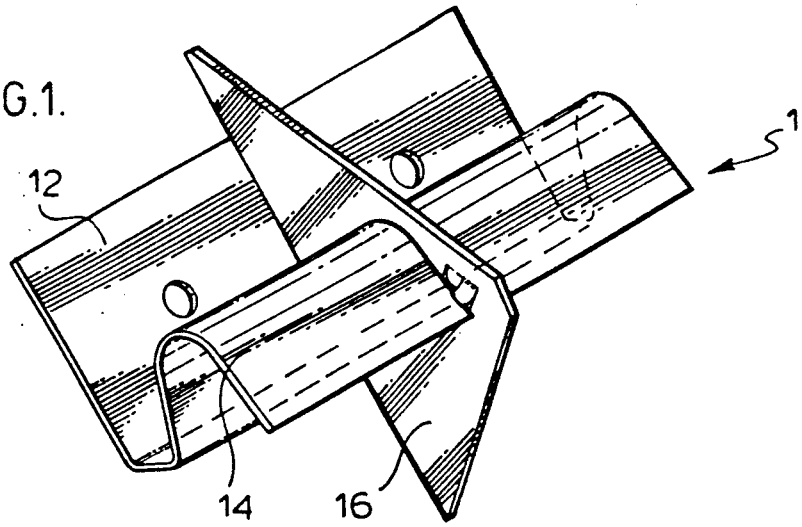
FIG. 1 is a perspective view of the preferred embodiment.

The preferred embodiment is generally illustrated as 1 in FIG. 1. In the preferred embodiment, clip 1 comprises a back plate 12, and an interlock portion 14 and fin 16.

Figure 2A:
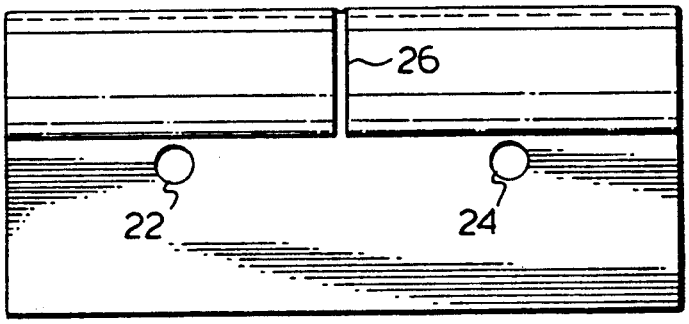
FIG. 2*a* is a top view of the clip of the embodiment of FIG. 1.
Figure 2B:
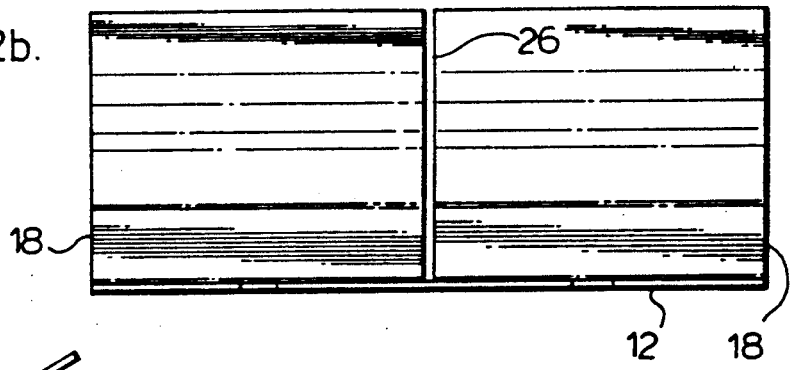
FIG. 2*b* is a front view of the clip of the embodiment of FIG. 1.
Figure 2C:
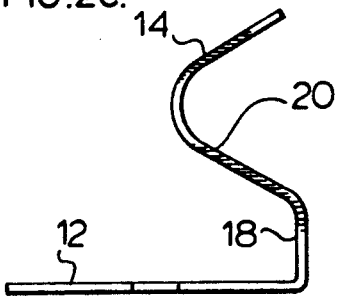
FIG. 2*c* is a side elevational view of the clip of the embodiment of FIG. 1.

With reference to FIG. 2, backplate 12 is substantially rectangular. Backplate 12 is provided with a pair of holes 22 and 24, each having a size for receiving a bolt, nail or screw. Interlock portion 14 has a rectangular portion 18 and a curved portion 20. Rectangular portion 18 is substantially perpendicular to backplate 12. Interlock portion 14 has a centrally located slot 26 having a thickness substantially the same as backplate 12.

Figure 3A:
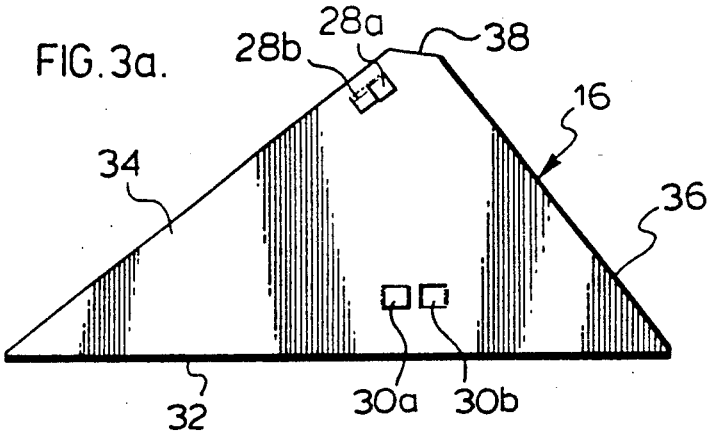
FIG. 3*a* is a front view of the fin of the embodiment of FIG. 1.
Figure 3B:
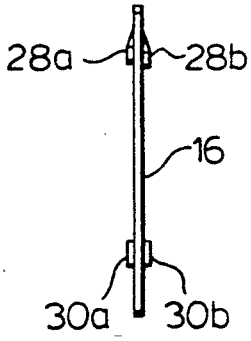
FIG. 3*b* is a side elevational view of the fin member of the embodiment of FIG. 1.

With reference to FIG. 3, fin 16 has a substantially rhombic configuration having a thickness generally equal to the thickness of clip 1. Fin member 16 is provided with two pairs of U-shaped cuts, 28*a* and 28*b*, 30*a* and 30*b*, lanced from opposite sides of fin 16. Fin 16 has a bottom edge 32, a long edge 34, a short edge 36 and a top edge 38. The distance between top edge 38 and bottom edge 32 of fin member 16 must be less than the thickness of the insulation panel to prevent a direct path of heat transfer from wall surface to the outer surface of insulation panels.

The arms of cuts 28*a* and 28*b* are perpendicular the long edge 34, while the arms of cuts 30*a* and 30*b* are parallel to the bottom edge 32. Cut 28*a* is lanced from one face of fin 16 while cut 28*b* is lanced from the opposite face to present an abutment surface. Similarly, cut 30*a* is from one face and 30*b* is from the opposite face to present opposed abutment surfaces spaced apart a distance substantially equal to the thickness of the clip 1.

Figure 4:
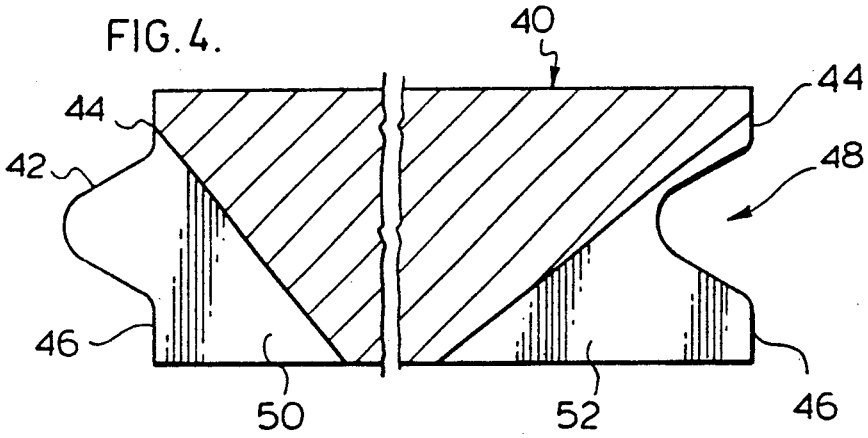
FIG. 4 is a sectional view along the line IV—IV of FIG. 5 of an insulation panel for use with the embodiment of FIG. 1.
Figure 5:
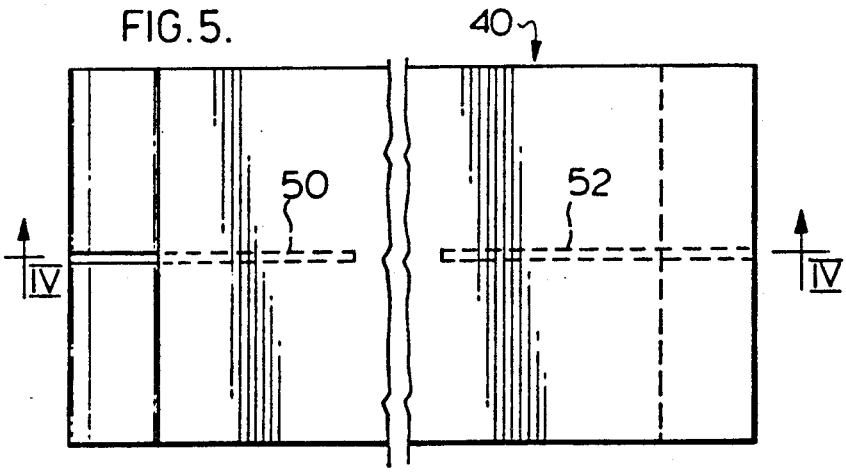
FIG. 5 is a front view of the insulation panel of FIG. 4 for use with the embodiment of FIG. 1.
Figure 6:
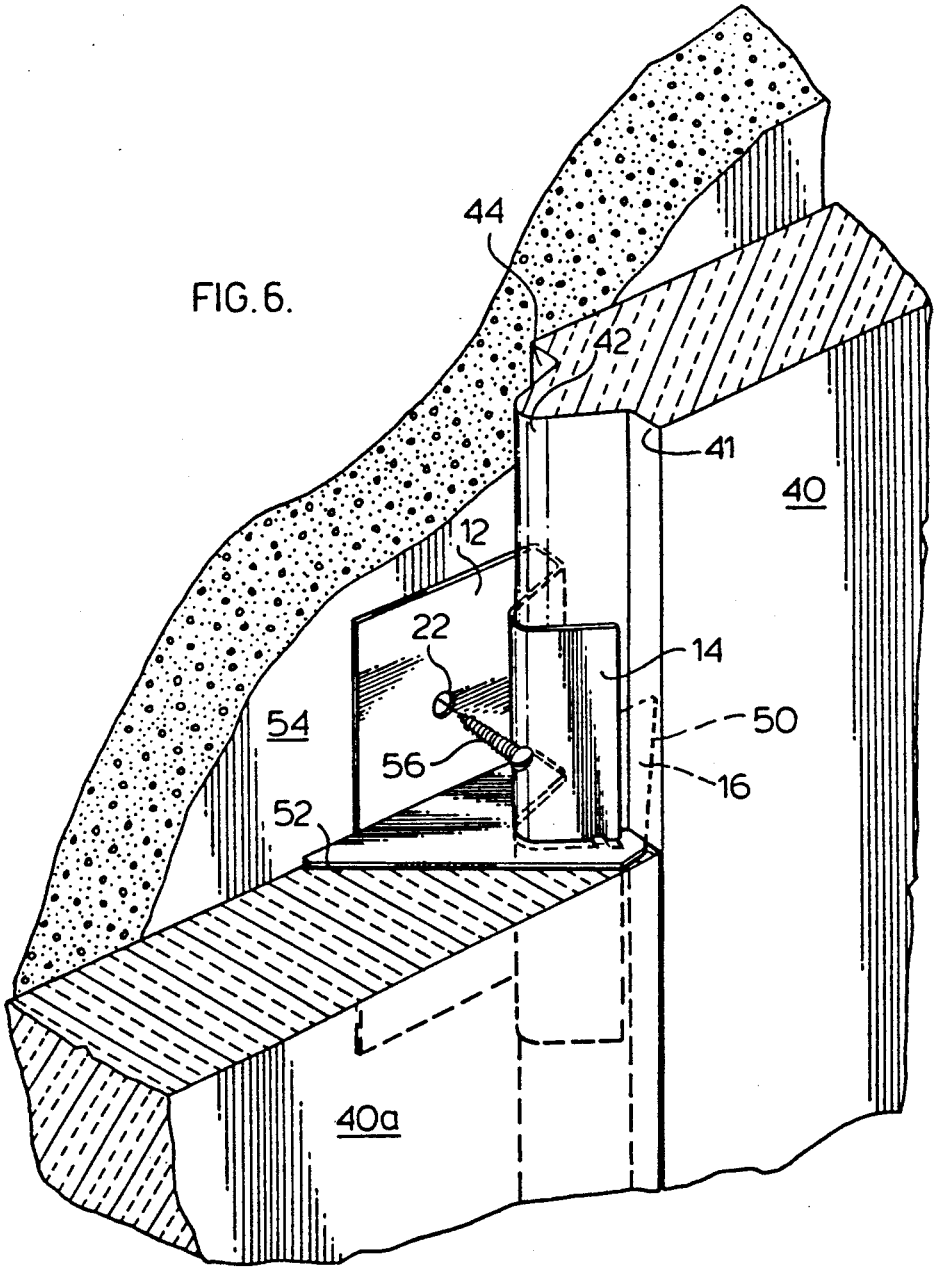
FIG. 6 is a perspective view partly in section of the embodiment of FIG. 1 installed between two insulation panels.

With reference to FIG. 4 and 5, insulation panel 40 is illustrated. On one of the edge surfaces of insulation panel 40 there is provided a tongue formation 42 extending along the length thereof. Tongue 42 has a thickness less than the thickness of insulation panel 40 defining planar surfaces 44 and 46.

As illustrated, the thickness of planar surface 46 is substantially the same as the height of rectangular portion 18 of clip 1. The curved portion 20 of the clip 1 has the same cross section as the tongue 42 such that clip 1 will fit snugly anywhere along the length of tongue 42.

Equally, the opposite edge surface of the insulation panel will have a complementary groove 48. The tongue of an adjacent like panel will fit snugly within complementary groove 48. Interlock portion 14 of clip 1 will also fit snugly within groove 48.

As is apparent, the shape and location of the tongue 42 of insulation panel 40 is not critical provided the tongue and groove are uniform and matingly engageable to present a substantially uniform surface. The corresponding interlock portion 14 of clip 1 is equally not critical provided the shape of interlock portion 14 is complimentary to tongue 42 and groove 48 of insulation panel 40.

In the preferred embodiment, back portion 12 is stamped out as an integral piece with interlock portion 14 being formed by bending the integral piece of sheet metal, having a zinc coating. Rib 16 is also made from sheet metal, having a zinc coating.

To assemble, rib 16 is inserted into slot 26 of interlock portion 14 with the point defined by short edge 34 and bottom edge 32 being closest to the bend between backplate 12 and interlock portion 14. Bottom edge 32 of rib 16 abuts with the backplate 12. Backplate 12 and rib 16 are moved relative to each other until U-shaped cuts 30*a* and 30*b* snappingly engage with rectangular portion 18 of interlock portion 14 thereby locking rib 16 substantially perpendicular to both backplate 12 and interlock portion 14. U-shaped cuts 28*a* and 28*b* contact the outer edge of interlock portion 14. The clip is now ready for installation.

With reference to FIG. 4 and 5, insulation panel 40 must be provided with slots 50 and 52 extending across from the face of insulation panel 40 for presenting to the wall surface to the longitudinal edge surface for receiving fin member 16. Slots 50 and 52 may be prepared by using a conventional saw to cut a slot in the back corners of insulation panel 40 at substantially equal heights from the bottom edge of the insulation panel. Alternatively, these slots may be cut at the factory and delivered to the user in a pre-cut condition.

Slot 50 has substantially the same shape as the short blade of fin 16 defined by short edge 36, bottom edge 32 up to the midpoint between cuts 30*a* and 30*b* and top edge 38. Slot 52 has the substantially the same shape as the long blade of fin 16 defined by long edge 34, bottom edge 32 up to the midpoint between cuts 30*a* and 30*b* and top edge 38. Slot 52 is preferably larger than slot 50 to provide substantially the same amount of lateral resistance when the fin 16 is installed.

To install an insulation panel to the outer surface of wall 54, insulation panel 40 is aligned at the desired location. Clip 1 is positioned along the side edge having the groove 48 of the insulation panel until fin member 16 extends into slot 52 and the interlock portion 14 abuts with groove 48. The insulation panel is placed aside. The locations of holes 22 and 24 are located on wall surface 54. If the clip is to be installed onto a concrete wall surface, pilot holes are drilled at the desired locations. Screws 56 can then be advanced through holes 22 and 24 using suitable anchors in the pilot holes to affix clip 1 to wall 54 in a manner well known in the art. The insulation panel is applied to the affixed clip by presenting groove 52 to fin 16 and aligning the panel in the desired orientation.

Similarly for the opposite edge of panel 40 a like clip is installed by presenting fin 16 to slot 50 of panel 40. Screws 56 are advanced through holes 22 and 24 firmly affixing clip 1 to the wall 54. Once two clips have been installed, insulation panel 40 is fully supported. However, it is usual to use two clips on each side of the panel for the panel to be fully secured.

Adjacent panel 40*a* may be installed in a like manner by abutting panel 40*a* with panel 40 with slot 52 being presented to fin 16. A third clip is presented to the tongue formation of insulation panel 40*a* until panel 40*a* is firmly affixed to the wall surface. The process is repeated until wall surface 54 is covered to the desired degree.

Similarly, the panel may be installed horizontally. It should be noted that when installing insulation panels in the horizontal orientation, the tongue formation should extend upwardly to prevent possible collection of moisture in the groove.

If insulation panel 40 is provided with a tongue and groove formation on the upper and lower edge surfaces, clip 1 may be used on these upper and lower edge surfaces. However, if the insulation panels are horizontal, clip 1 may be used with or without fin 16.

It is now apparent that the insulation panel 40 may be installed in either a horizontal or vertical orientation. The vertical panel orientation provides an added architectural dimension to the installed panel. Since the insulation clips are concealed from sight, the pre-finished insulation panel do not require further attention to have the desired architectural appearance.

While the present invention has been described in connection with a particular embodiment thereof, it will be understood by those skilled in the art that many changes and modifications may be made without departing from the true spirit and scope of the present invention.

I claim:

1. A clip for retaining an insulation panel to a planar surface, said insulation panel having an inner face for presenting to said planar surface, a tongue and groove formation on opposite edge surfaces thereof, respectively, for interlocking with adjacent like panels and a cut extending across from each of the opposite edge surfaces to said face, said clip comprising a rigid sheet base adapted to lie flush on the planar surface upon which the insulation panel is to be mounted and adapted to be secured to the planar surface and an interlock member extending substantially perpendicular from said base and adapted to the contour of the tongue and groove formation and terminating within the thickness of the insulation panel, said interlock member having a fin slot extending substantially perpendicular to said base for receiving a fin means, said fin means having means for engaging said interlock member and adapted for engagement with said cuts of said insulation panels whereby said fin means restricts relative sliding movement between the clip and the insulation panel when at least two like clips retain said insulation panel to the wall surface from said opposite edge surfaces.

2. A clip as claimed in claim 1 wherein said fin means is in snapping engagement with said interlock member.

3. A clip as claimed in claim 2 wherein said securement means comprises a first projection extending from the face of the fin means and a second projection extending from the opposite face of the fin means presenting abutment surfaces for retaining said interlock member therebetween in a snapping fit.

4. A clip as claimed in claim 2 wherein said securement means comprises a first pair of projections extending from opposite faces of the fin means adapted to snappingly engage said interlock member and a second pair projections extending from opposite faces of the fin means presenting abutment surfaces for retaining said interlock member in a snapping fit.

5. A clip as claimed in claim 3 or 4 wherein said projections are lanced in a substantially U-shape.

6. A clip as claimed in claim 5 wherein said fin means has a substantially rhombic shape integrally comprising a long blade and short blade wherein said long blade is adapted to be presented to the cut on the edge of the panel having the groove and the short blade is adapted to be presented to the cut on the edge of the panel having the tongue.

* * * * *